US010005989B2

(12) United States Patent
Cunningham

(10) Patent No.: US 10,005,989 B2
(45) Date of Patent: Jun. 26, 2018

(54) FRAGRANCE MATERIALS

(71) Applicant: The Procter & Gamble Company, Cincinnati, OH (US)

(72) Inventor: Philip Andrew Cunningham, Vossem (BE)

(73) Assignee: The Procter & Gamble Company, Cincinnati, OH (US)

( * ) Notice: Subject to any disclaimer, the term of this patent is extended or adjusted under 35 U.S.C. 154(b) by 0 days. days.

(21) Appl. No.: 15/097,481

(22) Filed: Apr. 13, 2016

(65) Prior Publication Data

US 2016/0230128 A1 Aug. 11, 2016

Related U.S. Application Data

(63) Continuation of application No. 14/250,405, filed on Apr. 11, 2014, now Pat. No. 9,340,757.

(60) Provisional application No. 61/813,315, filed on Apr. 18, 2013.

(51) Int. Cl.

| | |
|---|---|
| ***C11D 3/50*** | (2006.01) |
| ***D06M 13/00*** | (2006.01) |
| ***C11B 9/00*** | (2006.01) |
| ***C11D 11/00*** | (2006.01) |
| ***D06M 23/12*** | (2006.01) |

(52) U.S. Cl.

CPC ..... *C11D 3/50* (2013.01); *C11B 9/003* (2013.01); *C11B 9/008* (2013.01); *C11B 9/0015* (2013.01); *C11B 9/0019* (2013.01); *C11B 9/0034* (2013.01); *C11B 9/0038* (2013.01); *C11B 9/0042* (2013.01); *C11B 9/0046* (2013.01); *C11B 9/0049* (2013.01); *C11B 9/0053* (2013.01); *C11B 9/0057* (2013.01); *C11B 9/0061* (2013.01); *C11B 9/0076* (2013.01); *C11B 9/0092* (2013.01); *C11D 3/505* (2013.01); *C11D 11/0017* (2013.01); *C11D 11/0023* (2013.01); *D06M 13/005* (2013.01); *D06M 23/12* (2013.01)

(58) Field of Classification Search

CPC ..... C11D 3/50; C11B 9/0019

See application file for complete search history.

(56) References Cited

U.S. PATENT DOCUMENTS

| | | | | |
|---|---|---|---|---|
| 4,145,184 | A | 3/1979 | Brain et al. | |
| 4,209,417 | A | 6/1980 | Whyte | |
| 4,430,243 | A | 2/1984 | Bragg | |
| 4,515,705 | A | 5/1985 | Moeddel | |
| 5,061,393 | A | 10/1991 | Linares et al. | |
| 5,574,179 | A | 11/1996 | Wahl et al. | |
| 5,576,282 | A | 11/1996 | Miracle et al. | |
| 5,578,563 | A | 11/1996 | Trinh et al. | |
| 5,597,936 | A | 1/1997 | Perkins et al. | |
| 5,652,206 | A | 7/1997 | Bacon et al. | |
| 6,225,464 | B1 | 5/2001 | Hiler, II et al. | |
| 6,326,348 | B1 | 12/2001 | Vinson et al. | |
| 7,119,060 | B2 | 10/2006 | Shefer et al. | |
| 9,340,757 | B2 * | 5/2016 | Cunningham | C11D 3/505 |
| 2005/0049173 | A1 | 3/2005 | Blondeau et al. | |
| 2005/0227892 | A1 | 10/2005 | Shaukat et al. | |
| 2007/0275866 | A1 | 11/2007 | Dykstra | |
| 2008/0207481 | A1 * | 8/2008 | Meine | C11D 3/50 512/4 |
| 2009/0005280 | A1 | 1/2009 | Woo et al. | |
| 2010/0152083 | A1 * | 6/2010 | Velazquez | C11D 3/50 510/103 |
| 2014/0315772 | A1 | 10/2014 | Cunningham | |

FOREIGN PATENT DOCUMENTS

| | | | |
|---|---|---|---|
| EP | 0137616 | A1 | 4/1985 |

OTHER PUBLICATIONS

International Search Report; International Application No. PCT/US2014/034488; dated Jul. 11, 2014; 7 pages.

* cited by examiner

*Primary Examiner* — John R Hardee

(74) *Attorney, Agent, or Firm* — James F. McBride; Steven W. Miller

(57) ABSTRACT

The present application relates to perfume raw materials, perfumes, perfume delivery systems and consumer products comprising such perfume raw materials, perfumes and/or such perfume delivery systems, as well as processes for making and/or using such perfume raw materials, perfume delivery systems and consumer products. Such perfume raw materials, perfumes, perfume delivery systems and consumer products can reduce the impact of certain harsh odours.

14 Claims, No Drawings

FRAGRANCE MATERIALS

This is a continuation of U.S. patent application Ser. No. 14/250,405, filed Apr. 11, 2014, now U.S. Pat. No. 9,340,757, which claims priority from US Provisional Application 61/813,315, filed Apr. 18, 2013.

FIELD OF INVENTION

The present application relates to perfume raw materials, perfumes, perfume delivery systems and consumer products comprising such perfume raw materials, perfumes and/or such perfume delivery systems, as well as processes for making and/or using such perfume raw materials, perfumes, perfume delivery systems and consumer products.

BACKGROUND OF THE INVENTION

Consumer products may comprise one or more perfumes and/or perfume delivery systems that can provide a desired scent to such products and/or any situs that is contacted with such products. Consumer products such as hard surface cleaners, for example, limescale removers often use acids to aid the removal of deposits such as lime scale. Such acids have a harsh odour which results in a negative consumer response to the product and is challenging to overcome. Typically ingredients with a similarly strong intensity are employed to counter the original harsh odour. Unfortunately, such ingredients merely compete with and do not effectively neutralize the original harsh odour. As a result, the original harsh odour is still clearly noticeable.

Applicants recognized that the reason such harsh odour is so challenging to overcome is that such acids impact the trigeminal nerve. The trigeminal nerve (the fifth cranial nerve, also called the fifth nerve, or simply CNV or CN5) is a nerve responsible for sensation in the face and certain motor functions such as biting and chewing. It is the largest of the cranial nerves. Applicants recognized that the impact of harsh odours on the trigeminal nerve can be reduced with the use of specific perfume ingredients. Surprisingly, Applicants found that certain perfume materials and combinations thereof, which are independent of odour intensity, are capable of neutralizing the aforementioned harsh odours.

SUMMARY OF THE INVENTION

The present application relates to perfume raw materials, perfumes, perfume delivery systems and consumer products comprising such perfume raw materials, perfumes and/or such perfume delivery systems, as well as processes for making and/or using such perfume raw materials, perfume delivery systems and consumer products.

DETAILED DESCRIPTION OF THE INVENTION

Definitions

As used herein "consumer product" means baby care, beauty care, fabric & home care, family care, feminine care, health care, snack and/or beverage products, packaging or devices generally intended to be used or consumed in the form in which it is sold. Such products include but are not limited to diapers, bibs, wipes; products for and/or methods relating to treating hair (human, dog, and/or cat), including, bleaching, coloring, dyeing, conditioning, shampooing, styling; deodorants and antiperspirants; personal cleansing; cosmetics; skin care including application of creams, lotions, and other topically applied products for consumer use including fine fragrances; and shaving products, products for and/or methods relating to treating fabrics, hard surfaces and any other surfaces in the area of fabric and home care, including: air care including air fresheners and scent delivery systems, car care, dishwashing, fabric conditioning (including softening and/or freshening), laundry detergency, laundry and rinse additive and/or care, hard surface cleaning and/or treatment including floor and toilet bowl cleaners, and other cleaning for consumer or institutional use; products and/or methods relating to bath tissue, facial tissue, paper handkerchiefs, and/or paper towels; tampons, feminine napkins; products and/or methods relating to oral care including toothpastes, tooth gels, tooth rinses, denture adhesives, tooth whitening; over-the-counter health care including cough and cold remedies, pain relievers, RX pharmaceuticals, pet health and nutrition; processed food products intended primarily for consumption between customary meals or as a meal accompaniment (non-limiting examples include potato chips, tortilla chips, popcorn, pretzels, corn chips, cereal bars, vegetable chips or crisps, snack mixes, party mixes, multigrain chips, snack crackers, cheese snacks, pork rinds, corn snacks, pellet snacks, extruded snacks and bagel chips); and coffee.

As used herein, the term "cleaning and/or treatment composition" is a subset of consumer products that includes, unless otherwise indicated, beauty care, fabric & home care products. Such products include, but are not limited to, products for treating hair (human, dog, and/or cat), including, bleaching, coloring, dyeing, conditioning, shampooing, styling; deodorants and antiperspirants; personal cleansing; cosmetics; skin care including application of creams, lotions, and other topically applied products for consumer use including fine fragrances; and shaving products, products for treating fabrics, hard surfaces and any other surfaces in the area of fabric and home care, including: air care including air fresheners and scent delivery systems, car care, dishwashing, fabric conditioning (including softening and/or freshening), laundry detergency, laundry and rinse additive and/or care, hard surface cleaning and/or treatment including floor and toilet bowl cleaners, granular or powder-form all-purpose or "heavy-duty" washing agents, especially cleaning detergents; liquid, gel or paste-form all-purpose washing agents, especially the so-called heavy-duty liquid types; liquid fine-fabric detergents; hand dishwashing agents or light duty dishwashing agents, especially those of the high-foaming type; machine dishwashing agents, including the various tablet, granular, liquid and rinse-aid types for household and institutional use; liquid cleaning and disinfecting agents, including antibacterial hand-wash types, cleaning bars, mouthwashes, denture cleaners, dentifrice, car or carpet shampoos, bathroom cleaners including toilet bowl cleaners; hair shampoos and hair-rinses; shower gels, fine fragrances and foam baths and metal cleaners; as well as cleaning auxiliaries such as bleach additives and "stain-stick" or pre-treat types, substrate-laden products such as dryer added sheets, dry and wetted wipes and pads, nonwoven substrates, and sponges; as well as sprays and mists all for consumer or/and institutional use; and/or methods relating to oral care including toothpastes, tooth gels, tooth rinses, denture adhesives, tooth whitening.

As used herein, the term "fabric and/or hard surface cleaning and/or treatment composition" is a subset of cleaning and treatment compositions that includes, unless otherwise indicated, granular or powder-form all-purpose or "heavy-duty" washing agents, especially cleaning detergents; liquid, gel or paste-form all-purpose washing agents, especially the so-called heavy-duty liquid types; liquid fine-fabric detergents; hand dishwashing agents or light duty dishwashing agents, especially those of the high-foaming type; machine dishwashing agents, including the various tablet, granular, liquid and rinse-aid types for household and institutional use; liquid cleaning and disinfecting agents, including antibacterial hand-wash types, cleaning bars, car or carpet shampoos, bathroom cleaners including toilet bowl cleaners; and metal cleaners, fabric conditioning products including softening and/or freshening that may be in liquid, solid and/or dryer sheet form; as well as cleaning auxiliaries such as bleach additives and "stain-stick" or pre-treat types, substrate-laden products such as dryer added sheets, dry and wetted wipes and pads, nonwoven substrates, and sponges; as well as sprays and mists. All of such products which were applicable may be in standard, concentrated or even highly concentrated form even to the extent that such products may in certain aspect be non-aqueous.

As used herein, articles such as "a" and "an" when used in a claim, are understood to mean one or more of what is claimed or described.

As used herein, the terms "include", "includes" and "including" are meant to be non-limiting.

As used herein, the term "solid" includes granular, powder, bar and tablet product forms.

As used herein, the term "fluid" includes liquid, gel, paste and gas product forms.

As used herein, the term "situs" includes paper products, fabrics, garments, hard surfaces, hair and skin.

As used herein, the term "neat" when used in the context of a perfume, means the perfume is not part of/contained in a perfume delivery system.

As used herein, the term "hard surface", means any kind of surface typically found in and around houses like kitchens, bathrooms, e.g., floors, walls, tiles, windows, cupboards, sinks, showers, shower plastified curtains, wash basins, WCs, fixtures and fittings and the like made of different materials like ceramic, vinyl, no-wax vinyl, linoleum, melamine, glass, Inox®, Formica®, any plastics, plastified wood, metal or any painted or varnished or sealed surface and the like. Hard surfaces also include household appliances including, but not limited to refrigerators, freezers, washing machines, automatic dryers, ovens, microwave ovens, dishwashers and so on. Such hard surfaces may be found both in private households as well as in commercial, institutional and industrial environments. Hard surfaces may further include dish surfaces.

As used herein, the term "dish surfaces" means any kind of surfaces found in dish cleaning, such as dishes, cutlery, cutting boards, pans, and the like. Such dish surfaces may be found both in private households as well as in commercial, institutional and industrial environments.

As used herein, the term "neutralising" means reducing sensitivity to perceiving an odour. For example, a fragrance or fragrance material is considered neutralising when the formic acid odour is significantly reduced. This is measure on a 5 point scale where 5 indicates no neutralising effect and zero would mean complete neutralisation for the acidic odour according to the method described in the Test Methods section of this specification.

Unless otherwise noted, all component or composition levels are in reference to the active portion of that component or composition, and are exclusive of impurities, for example, residual solvents or by-products, which may be present in commercially available sources of such components or compositions.

All percentages and ratios are calculated by weight unless otherwise indicated. All percentages and ratios are calculated based on the total composition unless otherwise indicated.

It should be understood that every maximum numerical limitation given throughout this specification includes every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

Perfumes

Suitable perfume raw materials and perfumes for neutralizing harsh odours, in particular harsh odours that impact the trigeminal nerve, for example harsh odours resulting from materials selected from the group consisting of phosphoric acid, salts thereof, and mixtures thereof; formic acid, salts thereof, and mixtures thereof; acetic acid, salts thereof, and mixtures thereof; citric acid, citrate, salts thereof, and mixtures thereof; lactic acid, salts thereof, and mixtures thereof; oxalic acid, salts thereof, and mixtures thereof; sulfuric acid, salts thereof, and mixtures thereof, are listed in Tables 1 and 2 below.

| Material number | CAS No | Material name |
|---|---|---|
| 1 | 1490-04-6 | menthol |
| 2 | 5989-27-5 | Orange CP |
| 3 | 5989-27-5 | Orange Terpenes |
| 4 | 93-08-3 | Methyl Beta-Naphthyl Ketone |
| 5 | 33704-61-9 | Cashmeran |
| 6 | 7786-44-9 | 2 6 Nonadienol 10% In DPG |
| 7 | 8000-41-7 | terpineol |
| 8 | 125-12-2 | Isobornyl acetate |
| 9 | 193425-86-4 | Scentenal |
| 10 | 54464-57-2 | Iso-E Super |
| 11 | 1191-16-8 | Prenyl Acetate |
| 12 | 127-91-3 | beta-pinene |
| 13 | 5989-27-5 | lemon CP |
| 14 | 628-63-7 | Amyl acetate |
| 15 | 84697-09-6 | Acalea |
| 16 | 127-51-5 | Ionone Gamma Methyl |
| 17 | 103614-86-4 | Octalynol |
| 18 | 32210-23-4 | 4-tert-Butylcyclohexyl acetate |
| 19 | 198404-98-7 | Javanol |
| 20 | 2756-56-1 | bornyl propionate |
| 21 | 68527-79-7 | Indolene |
| 22 | 78-70-6 | Linalool |
| 23 | 120-72-9 | Indol |
| 24 | 1191-16-8 | Prenyl Acetate |
| 25 | 224031-70-3 | Spirogalbanone |
| 26 | 104-67-6 | (R)-gamma-Undecalactone |
| 27 | 104-61-0 | Nonalactone |
| 28 | 10461-98-0 | peonile |
| 29 | 27606-09-3 | Magnolan |
| 30 | 5989-27-5 | Orange Terpenes |
| 31 | 109-29-5 | Hexadecanolide |
| 32 | 495-62-5 | Bisabolene |
| 33 | 76842-49-4 | Frutene |
| 34 | 82356-51-2 | Muscenone |
| 35 | 928-96-1 | cis-3-Hexen-1-ol |
| 36 | 106-72-9 | Melonal |
| 37 | 1205-17-0 | Helional |
| 38 | 6259-76-3 | Hexyl Salicylate |
| 39 | 102-20-5 | Phenethyl phenylacetate |
| 40 | 106-21-8 | 3,7-dimethyl-1-octanol |
| 41 | 84560-00-9 | Cyclopentol |
| 42 | 30772-79-3 | Melozone |
| 43 | 151-05-3 | Dimethyl Benzyl Carbinyl Acetate |

-continued

| Material number | CAS No | Material name |
|---|---|---|
| 44 | 103-48-0 | Phenyl Ethyl Iso Butyrate |
| 45 | 115-95-7 | Linalyl Acetate |
| 46 | 104-54-1 | Cinnamic Alcohol |
| 47 | 124-13-0 | Octanal |
| 48 | 140-11-4 | Benzyl Acetate |
| 49 | 142-92-7 | Hexyl Acetate |
| 50 | 171102-41-3 | Flor acetate |
| 51 | 2705-87-5 | Allyl cyclohexyl propionate |
| 52 | 31906-04-4 | Lyral |
| 53 | 68039-49-6 | Ligustral Or Triplal |
| 54 | 76-22-2 | Camphor Gum |
| 55 | 77-53-2 | Cedrol |
| 56 | 79-78-7 | Hexalon |
| 57 | 1222-05-5 | Galaxolide |
| 58 | 16510-27-3 | Toscanol |
| 59 | 103-41-3 | Benzyl cinnamate |
| 60 | 14901-07-6 | beta-Ionone |
| 61 | 236391-76-7 | Romanolide |
| 62 | 23911-56-0 | Nerolione |
| 63 | 24683-00-9 | galbazine |
| 64 | 507-70-0 | Borneol |
| 65 | 54982-83-1 | Cyclic ethylene dodecanedioate |
| 66 | 777-50-2 | ambrettolide |
| 67 | 8007-35-0 | terpinyl acetate |
| 68 | 18871-14-2 | Jasmal |
| 69 | 111879-80-2 | Habanolide |
| 70 | 101-86-0 | Hexyl Cinnamic Aldehyde |
| 71 | 128-51-8 | Nopyl Acetate |
| 72 | 2437-25-4 | Clonal |
| 73 | 24851-98-7 | Methyl Dihydro Jasmonate |
| 74 | 7452-79-1 | Ethyl-2-Methyl Butyrate |

-continued

| Material number | CAS No | Material name |
|---|---|---|
| 75 | 5956-12-7 | gamma-Dodecalactone |
| 76 | 60-12-8 | Phenyl Ethyl Alcohol |
| 77 | 28645-51-4 | Isoambrettolide |
| 78 | 57345-19-4 | Amberketal-IPM |
| 79 | 80-56-8 | alpha-pinene |
| 80 | 89-43-0 | Aurantiol |
| 81 | 106-24-1 | Geraniol |
| 82 | 3658-77-3 | Furaneol |
| 83 | 39255-32-8 | Ethyl 2 Methyl Pentanoate |
| 84 | 5392-40-5 | Citral |
| 85 | 105-87-3 | Geranyl Acetate |
| 86 | 118-58-1 | Benzyl Salicylate |
| 87 | 67634-20-2 | Cyclabute |
| 88 | 97-54-1 | Iso Eugenol |
| 89 | 10235-63-9 | gamma-Terpinyl acetate |
| 90 | 110-27-0 | Isopropyl myristate |
| 91 | 113889-23-9 | cyclobutanate |
| 92 | 123-95-5 | Butyl stearate |
| 93 | 130786-09-3 | salicanyle |
| 94 | 134-20-3 | methyl anthranilate |
| 95 | 141773-73-1 | Helvetolide |
| 96 | 143-08-8 | Nonanol |
| 97 | 15323-35-0 | 5-Acetyl-1,1,2,3,3,6-hexamethylindan aka phantolid |
| 98 | 20665-85-4 | Vanillin isobutyrate |
| 99 | 3681-71-8 | cis-3-Hexenyl acetate |
| 100 | 37609-25-9 | 5-Cyclohexadecenone |
| 101 | 470-82-6 | Eucalyptol |
| 102 | 77-54-3 | Cedryl acetate |
| 103 | 93-92-5 | Styrallyl acetate |

TABLE 2

| | | Perfumes | | | | |
|---|---|---|---|---|---|---|
| CAS No | Raw material name | Perfume 1 | Perfume 2 | Perfume 3 | Perfume 4 | Perfume 5 |
| 1490-04-6 | menthol | | | 0.4 | 0.5 | 2 |
| 101-86-0 | Hexyl Cinnamic Aldehyde | 20 | | | | |
| 10235-63-9 | gamma-Terpinyl acetate | | | 5 | 5 | 5 |
| 104-54-1 | Cinnamic Alcohol | | 0.2 | | | |
| 104-61-0 | gamma-Nonalactone | | | | 1 | 1 |
| 10461-98-0 | peonile | | | | 4 | 4 |
| 104-67-6 | Undecalactone | 10 | 5 | 2 | 2 | 2 |
| 105-87-3 | Geranyl Acetate | | 1 | | | |
| 105-95-3 | Ethylene Brassylate | | 15 | | | |
| 106-21-8 | 3,7-dimethyl-1-octanol | | | | | 4 |
| 106-24-1 | Geraniol | | 2 | | | |
| 106-72-9 | Melonal | | 0.2 | | | |
| 109-29-5 | Hexadecanolide | | | | 3 | 6 |
| 111879-80-2 | Habanolide 100% | | 3 | 3 | 3 | |
| 112-54-9 | Lauric Aldehyde | 0.5 | | | | |
| 115-95-7 | Linalyl Acetate | | 4.2 | | | |
| 1191-16-8 | Prenyl Acetate | | 0.4 | 1 | 1 | 1 |
| 1205-17-0 | Helional | | 2 | | | |
| 125-12-2 | Isobornyl acetate | 10 | | 10 | 10 | 5 |
| 127-51-5 | Ionone Gamma Methyl | | 8 | 4 | 4 | 4 |
| 127-91-3 | beta-pinene | | | 5 | 5 | 5 |
| 128-51-8 | Nopyl Acetate | | 2 | | | |
| 140-11-4 | Benzyl Acetate | | 2.1 | | | |
| 142-92-7 | Hexyl Acetate | | 1.6 | 2 | 1 | 1 |
| 151-05-3 | Dimethyl Benzyl Carbinyl Acetate | | 1 | | | |

TABLE 2-continued

| | | Perfumes | | | | |
|---|---|---|---|---|---|---|
| CAS No | Raw material name | Perfume 1 | Perfume 2 | Perfume 3 | Perfume 4 | Perfume 5 |
| 193425-86-4 | Scentenal | | | 0.5 | | |
| 224031-70-3 | Spirogalbanone | 0.2 | | 0.1 | 0.1 | 0.1 |
| 24851-98-7 | Methyl dihydrojasmonate | | 10 | 15.3 | 8 | 6 |
| 2756-56-1 | bornyl propionate | | | | 3 | 3 |
| 30772-79-3 | Melozone | | | 0.5 | | |
| 31906-04-4 | Lyral | | 2 | | | |
| 32210-23-4 | 4-tert-Butylcyclohexyl acetate | | | | | 5 |
| 32388-55-9 | Methyl Cedrylone | | 1 | | | |
| 33673-62-0 | Nonalactone | | 0.2 | | | |
| 33704-61-9 | Cashmeran | | | | 1 | 2 |
| 39255-32-8 | Ethyl 2 Methyl Pentanoate | | 0.4 | | | |
| 495-62-5 | Bisabolene | | | 2 | 2 | |
| 507-70-0 | Borneol | | | 1 | 1 | 1 |
| 5392-40-5 | Citral | | 0.3 | | | |
| 54464-57-2 | Iso-E Super | 19.3 | 10 | 10 | 10 | 9.3 |
| 54830-99-8 | Flor Acetate | 10 | | | | |
| 54982-83-1 | Cyclic ethylene dodecanedioate | | | 2 | 2 | 2 |
| 5989-27-5 | lemon CP | | | | 4 | |
| 60-12-8 | Phenyl Ethyl Alcohol | | 2 | | | |
| 6259-76-3 | Hexyl Salicylate | | 4 | | | |
| 628-63-7 | Amyl acetate | | | 1 | 1 | 1 |
| 63500-71-0 | Pyranol | | 6 | | | |
| 67633-96-9 | Liffarome | | 0.2 | | | |
| 68039-49-6 | Ligustral Or Triplal | | 0.8 | | | |
| 68912-13-0 | Frutene | 20 | | | | |
| 7452-79-1 | Ethyl-2-Methyl Butyrate | | 0.4 | | | |
| 76-22-2 | Camphor Gum | | 0.2 | | | |
| 76842-49-4 | Frutene | | | 3 | 3 | 3 |
| 777-50-2 | ambrettolide | | | 0.5 | | |
| 7786-44-9 | 2 6 Nonadienol 10% In DPG | | 0.2 | 0.2 | 0.2 | 0.2 |
| 78-70-6 | Linalool | | 10.5 | 10 | 10 | 7 |
| 8000-41-7 | terpineol | | | | 2 | 2 |
| 8007-35-0 | terpinyl acetate | | | 3 | 3 | |
| 8028-48-6 | Orange Terpenes | | 4 | | | |
| 82356-51-2 | Muscenone | | | | | 0.2 |
| 84560-00-9 | Cyclopentol | | | | 3 | 3 |
| 84697-09-6 | Acalea | | | 10 | 7 | 10 |
| 88-41-5 | Verdox | 10 | | | | |
| 928-96-1 | cis-3-Hexen-1-ol | | | | 0.2 | 0.2 |
| 93-08-3 | Methyl Beta Naphthyl Ketone | | 0.1 | 0.5 | | |
| | Orange Terpenes | | | 8 | | 5 |

The Table 1 materials and Table 2 perfumes disclosed in the present specification may be used in any combination in any type of consumer product.

In one aspect, a perfume composition comprising a material selected from the group consisting of Table 1 materials and mixtures thereof and/or a perfume selected from the group consisting of a Table 2 perfume and mixtures thereof is disclosed.

In one aspect, said perfume comprises, based on total perfume composition weight, at least 10%, at least 20%, at least 30%, at least 40%, at least 50%, at least 60%, at least 70%, at least 80%, at least 90%, at least 95%, of a material selected from the group consisting of Table 1 materials and mixtures thereof.

In one aspect, said perfume comprises, based on total perfume composition weight, at least 10%, at least 20%, at least 30%, at least 40%, at least 50%, at least 60%, at least 70%, at least 80%, at least 90%, at least 95%, of a material selected from the group consisting of Table 1 materials numbers 1-35 and mixtures thereof.

In one aspect, a consumer product comprising, based on total consumer product weight, from about 0.0001% to about 100% of a said perfume and or a delivery system comprising a material selected from the group consisting of Table 1 materials and mixtures thereof and/or a perfume selected from the group consisting of a Table 2 perfume and mixtures thereof, the balance of said consumer product comprising an adjunct ingredient is disclosed.

In one aspect, said consumer product has a pH from about 6.99 to about 0.01, from about 5 to about 0.2, from about 4 to about 0.3, or from about 4 to about 0.8.

A consumer product comprising, based on total consumer product weight, from about 0.0001% to about 100% of a material selected from the group consisting of Table 1 materials and mixtures thereof and/or a perfume selected from the group consisting of a Table 2 perfume and mixtures thereof, the balance of consumer product comprising an adjunct ingredient, and/or a perfume delivery system comprising a material selected from the group consisting of Table 1 materials and mixtures thereof and/or a perfume selected from the group consisting of a Table 2 perfume and mixtures thereof is also disclosed.

A cleaning and/or treatment composition comprising based on total cleaning and treatment products weight from about 0.0001% to about 25% of a material selected from the group consisting of Table 1 materials and mixtures thereof and/or a perfume selected from the group consisting of a Table 2 perfume and mixtures thereof and an adjunct ingredient is also disclosed.

A fabric and/or hard surface cleaning and/or treatment composition comprising, based on total fabric and/or hard surface cleaning and/or treatment composition weight of from about 0.00001% to about 25% of a material selected from the group consisting of Table 1 materials and mixtures thereof and/or a perfume selected from the group consisting of a Table 2 perfume and mixtures thereof and an adjunct ingredient is also disclosed.

A detergent comprising, based on total fabric and/or hard surface cleaning and/or treatment composition weight of from about 0.00001% to about 25% of a material selected from the group consisting of Table 1 materials and mixtures thereof and/or a perfume selected from the group consisting of a Table 2 perfume and mixtures thereof and an adjunct ingredient is also disclosed.

A highly compacted consumer product comprising, based on total highly compacted consumer product composition weight, from about 0.00001% to about 25% of a material selected from the group consisting of Table 1 materials and mixtures thereof and/or a perfume selected from the group consisting of a Table 2 perfume and mixtures thereof and an adjunct ingredient is also disclosed.

A consumer product comprising, based on total consumer product weight, from about 0.0001% to about 100% of a material selected from the group consisting of Table 1 materials and mixtures thereof and/or a perfume selected from the group consisting of a Table 2 perfume and mixtures thereof, the balance of said consumer product comprising an adjunct ingredient, and/or a perfume delivery system comprising a one or more Class I and or II perfume raw materials is also disclosed.

A cleaning and/or treatment composition comprising based on total composition weight, from about 0.0001% to about 25% of a material selected from the group consisting of Table 1 materials and mixtures thereof and/or a perfume selected from the group consisting of a Table 2 perfume and mixtures thereof and an adjunct ingredient is also disclosed.

A fabric and/or hard surface cleaning and/or treatment composition comprising, based on total composition weight, from about 0.00001% to about 25% of a material selected from the group consisting of Table 1 materials and mixtures thereof and/or a perfume selected from the group consisting of a Table 2 perfume and mixtures thereof and an adjunct ingredient is also disclosed.

A detergent comprising, based on total detergent weight, from about 0.00001% to about 25% of a material selected from the group consisting of Table 1 materials and mixtures thereof and/or a perfume selected from the group consisting of a Table 2 perfume and mixtures thereof and an adjunct ingredient is also disclosed.

A highly compacted consumer product comprising, based on total highly compacted consumer product composition weight, from about 0.00001% to about 25% of a material selected from the group consisting of Table 1 materials and mixtures thereof and/or a perfume selected from the group consisting of a Table 2 perfume and mixtures thereof and an adjunct ingredient is also disclosed.

A fabric care composition comprising a material selected from the group consisting of Table 1 materials and mixtures thereof and/or a perfume selected from the group consisting of a Table 2 perfume and mixtures thereof, said fabric care composition being selected from the group consisting of detergents, fabric softeners, and laundry additives, a) said detergent being:
   (i) a liquid detergent comprising a material selected from an anti-redep polymer, an enzyme, a structurant and mixtures thereof;
   (ii) a powder or granule detergent comprising a material selected from the group consisting of an anti-redep polymer, an enzymes, a bleach and mixtures thereof;
   (iii) a unit dose comprising a material selected from the group consisting of an anti-redep polymer, an enzymes, a bleach, a soluble substrate/film and mixtures thereof;
b) said fabric softener being a liquid, powder or sheet comprising a fabric softener active and an optional structurant;
c) said laundry additive being:
   (i) a bleach additive comprising a material selected from the group consisting of hypochlorite, hydrogen peroxide and mixtures thereof;
   (ii) a pretreater comprising a material selected from the group consisting of an effervescent, a propellant and mixtures thereof; and
   (iii) an in-wash boosters comprising a material selected from the group consisting of an enzyme, a non-chlorine bleach and mixtures thereof is also disclosed.

A home care composition comprising a material selected from the group consisting of Table 1 materials and mixtures thereof and/or a perfume selected from the group consisting of a Table 2 perfume and mixtures thereof, said home care composition being selected from the group consisting of an automatic dish washing composition, and a hard surface cleaning composition, a) said automatic dish washing composition being:
   (i) a liquid or gel comprising a material selected from an anti-redep polymer, an enzyme, a structurant, a shine/sheeting polymer and mixtures thereof;
   (ii) a powder or granule comprising a material selected from the group consisting of an anti-redep polymer, an enzyme, a bleach, a shine/sheeting polymer and mixtures thereof;
   (iii) a unit dose comprising a material selected from the group consisting of an anti-redep polymer, an enzymes, a bleach, a shine/sheeting polymer, a soluble substrate/film and mixtures thereof
b) said hard surface cleaning composition comprising a material selected from the group consisting of an anti-bacterial, a strong acid, preferably selected from the group consisting of glycolic acid, citric acid and mixtures thereof, etc., a strong base, preferably selected from the group consisting of a Na hydroxides, a Li hydroxide and mixtures thereof, an effervescent, a propellants, a shine/sheeting polymers and mixtures thereof is also disclosed.

In one aspect of the present invention, the consumer product is a liquid detergent composition, in one aspect, a hard surface cleaning composition. Such liquid detergent composition typically contains one or more acidic components selected from the group consisting of phosphoric acid, salts thereof, and mixtures thereof; formic acid, salts thereof, and mixtures thereof; acetic acid, salts thereof, and mixtures thereof; citric acid, citrate, salts thereof, and mixtures thereof; lactic acid, salts thereof, and mixtures thereof; oxalic acid, salts thereof, and mixtures thereof; sulfuric acid, salts thereof, and mixtures thereof; and mixtures thereof. In one aspect, the one or more acidic components are selected from the group consisting of phosphoric acid, salts thereof, and mixtures thereof; formic acid, salts thereof, and mixtures thereof; acetic acid, salts thereof, and mixtures thereof; citric acid, citrate, salts thereof, and mixtures thereof; lactic acid, salts thereof, and mixtures thereof; oxalic acid salts thereof, and mixtures thereof; and mixtures thereof. In one aspect, the liquid detergent composition may comprise a combination of at least two acidic components selected from the group consisting of phosphoric acid, salts thereof, and mixtures thereof; formic acid, salts thereof, and mixtures thereof; acetic acid, salts thereof, and mixtures thereof; citric acid, citrate, salts thereof, and mixtures thereof; lactic acid, salts thereof, and mixtures thereof; oxalic acid, salts thereof, and mixtures thereof; sulfuric acid, salts thereof, and mixtures thereof; and mixtures thereof. In one aspect, the at least two acidic components are different (i.e. not the same acidic component or salt thereof). Such liquid detergent compositions comprise a material selected from the group consisting of Table 1 materials and mixtures thereof and/or a perfume selected from the group consisting of a Table 2 perfume and mixtures thereof.

In one aspect, the embodiments detailed (any and all consumer product embodiments) above comprise, a material selected from Table 1 materials 1-35 and mixtures thereof.

In one aspect, the embodiments detailed above (any and all consumer product embodiments) comprise, a material selected from Table 1 materials 36-104 and mixtures thereof.

In one aspect, the embodiments detailed above (any and all consumer product embodiments) comprise, a perfume selected from Table 2 perfumes 1-5 and mixtures thereof.

In one aspect, the embodiments detailed above (any and all consumer product embodiments) comprise, a perfume selected from Table 2 perfumes 1-5.

Perfume Delivery Systems

Certain perfume delivery systems, methods of making certain perfume delivery systems and the uses of such perfume delivery systems are disclosed in USPA 2007/0275866 A1. Such perfume delivery systems include:

Reservoir Systems: Reservoir systems are also known as a core-shell type technology, or one in which the fragrance is surrounded by a perfume release controlling membrane, which may serve as a protective shell. The material inside the microcapsule is referred to as the core, internal phase, or fill, whereas the wall is sometimes called a shell, coating, or membrane. Microparticles or pressure sensitive capsules or microcapsules are examples of this technology. Microcapsules of the current invention are formed by a variety of procedures that include, but are not limited to, coating, extrusion, spray-drying, interfacial, in-situ and matrix polymerization. The possible shell materials vary widely in their stability toward water. Among the most stable are polyoxymethyleneurea (PMU)-based materials, which may hold certain PRMs for even long periods of time in aqueous solution (or product). Such systems include but are not limited to urea-formaldehyde and/or melamine-formaldehyde. Gelatin-based microcapsules may be prepared so that they dissolve quickly or slowly in water, depending for example on the degree of cross-linking. Many other capsule wall materials are available and vary in the degree of perfume diffusion stability observed. Without wishing to be bound by theory, the rate of release of perfume from a capsule, for example, once deposited on a surface is typically in reverse order of in-product perfume diffusion stability. As such, urea-formaldehyde and melamine-formaldehyde microcapsules for example, typically require a release mechanism other than, or in addition to, diffusion for release, such as mechanical force (e.g., friction, pressure, shear stress) that serves to break the capsule and increase the rate of perfume (fragrance) release. Other triggers include melting, dissolution, hydrolysis or other chemical reaction, electromagnetic radiation, and the like. Suitable capsule wall materials include, in addition to aminoplasts, polyvinyl alcohol, polyvinyl pyrrolidone, polyethylene glycol, polysaccharides and modified polysaccharides, gel forming proteins, modified celluloses such as carboxymethylcelluloses and hydroxyethylcelluloses, polyacrylates, polyureas, polyurethanes and mixtures thereof. The capsules may be further coated with an additional coating that can improve the deposition and/or retention of the capsule on the desired surface. Suitable coating materials include a cationic polymer selected from the group consisting of selected from the group consisting of polysaccharides, cationically modified starch, cationically modified guar, polysiloxanes, poly diallyl dimethyl ammonium halides, copolymers of poly diallyl dimethyl ammonium chloride and vinyl pyrrolidone, acrylamides, imidazoles, imidazolinium halides, imidazolium halides, poly vinyl amine, copolymers of poly vinyl amine and N-vinyl formamide to the surface of the capsule to form a cationically coated polymer encapsulated material. Typical capsules have a diameter of 1 micron to 500 microns. The use of pre-loaded microcapsules requires the proper ratio of in-product stability and in-use and/or on-surface (on-situs) release, as well as proper selection of PRMs. Microcapsules that are based on urea-formaldehyde and/or melamine-formaldehyde are relatively stable, especially in near neutral aqueous-based solutions. These materials may require a friction trigger which may not be applicable to all product applications. Other microcapsule materials (e.g., gelatin) may be unstable in aqueous-based products and may even provide reduced benefit (versus free perfume control) when in-product aged.

Molecule-Assisted Delivery (MAD): Non-polymer materials or molecules may also serve to improve the delivery of perfume. Without wishing to be bound by theory, perfume may non-covalently interact with organic materials, resulting in altered deposition and/or release. Non-limiting examples of such organic materials include but are not limited to hydrophobic materials such as organic oils, waxes, mineral oils, petrolatum, fatty acids or esters, sugars, surfactants, liposomes and even other perfume raw material (perfume oils), as well as natural oils, including body and/or other soils. Perfume fixatives are yet another example. In one aspect, non-polymeric materials or molecules have a C Log P greater than about 2. Molecule-Assisted Delivery (MAD) may also include those described in U.S. Pat. No. 7,119,060.

Starch Encapsulated Accord (SEA): The use of a starch encapsulated accord (SEA) technology allows one to modify the properties of the perfume, for example, by converting a liquid perfume into a solid by adding ingredients such as starch. The benefit includes increased perfume retention during product storage, especially under non-aqueous conditions. Upon exposure to moisture, a perfume bloom may be triggered. Benefits at other moments of truth may also be achieved because the starch allows the product formulator to select PRMs or PRM concentrations that normally cannot be used without the presence of SEA. Another technology example includes the use of other organic and inorganic materials, such as silica to convert perfume from liquid to solid.

In one aspect, a material selected from the group consisting of Table 1 materials and mixtures thereof and/or a perfume selected from the group consisting of a Table 2 perfume and mixtures thereof are suitable for use, in perfume delivery systems at levels, based on total perfume delivery system weight, of from 0.001% to about 50%, from 0.005% to 30%, from 0.01% to about 10%, from 0.025% to about 5%, or even from 0.025% to about 1%.

In one aspect, the perfume delivery systems disclosed herein are suitable for use in consumer products, cleaning and treatment compositions and fabric and hard surface cleaning and/or treatment compositions, detergents, and highly compacted consumer products, including highly compacted fabric and hard surface cleaning and/or treatment compositions, for example highly compacted detergents that may be solids or fluids, at levels, based on total consumer product weight, from about 0.001% to about 20%, from about 0.01% to about 10%, from about 0.05% to about 5%, from about 0.1% to about 0.5%.

In one aspect, the amount of the material selected from the group consisting of Table 1 materials and mixtures thereof and/or a perfume selected from the group consisting of a Table 2 perfume and mixtures thereof, based on the Reservoir System weight, may be from about 0.1% to about 99%, from 25% to about 95%, from 30 to about 90%, from 45% to about 90%, from 65% to about 90%.

In one aspect, the amount of a material selected from the group consisting of Table 1 materials and mixtures thereof and/or a perfume selected from the group consisting of a Table 2 perfume and mixtures thereof based on total weight of starch encapsulates and starch agglomerates (Starch Encapsulated Accord (SEA)) ranges from 0.1% to about 99%, from 25% to about 95%, from 30 to about 90%, from 45% to about 90%, from 65% to about 90%. In one aspect, the perfumes disclosed in Table 1 and stereoisomers thereof are suitable for use, in such starch encapsulates and starch agglomerates. Such PRMs and stereoisomers thereof may be used in combination in such starch encapsulates and starch agglomerates.

Thus, in addition to the disclosure above, an encapsulate comprising shell and a core, said core comprising of a material selected from the group consisting of Table 1 materials and mixtures thereof and/or a perfume selected from the group consisting of a Table 2 perfume and mixtures thereof is disclosed.

In one aspect, the delivery system embodiments detailed above comprise, a material selected from Table 1 materials 1-35 and mixtures thereof.

In one aspect, the delivery system embodiments detailed above comprise, a material selected from Table 1 materials 36-103 and mixtures thereof.

In one aspect, the delivery system embodiments detailed above comprise, a perfume selected from Table 2 perfumes 1-5 and mixtures thereof.

In one aspect, the delivery system embodiments detailed above comprise, a perfume selected from Table 2 perfumes 1-5.

Adjunct Ingredients

For the purposes of the present invention, the non-limiting list of adjuncts illustrated hereinafter are suitable for use in the instant compositions and may be desirably incorporated in certain aspects of the invention, for example to assist or enhance performance, for treatment of the substrate to be cleaned, or to modify the aesthetics of the composition as is the case with perfumes, colorants, dyes or the like. It is understood that such adjuncts are in addition to the components that are supplied via Applicants' perfumes and/or perfume systems. The precise nature of these additional components, and levels of incorporation thereof, will depend on the physical form of the composition and the nature of the operation for which it is to be used.

Suitable additional materials include, but are not limited to, bleach activators, antimicrobial, surfactants, builders, chelating agents, dye transfer inhibiting agents, dispersants, enzymes, and enzyme stabilizers, catalytic materials, bleach activators, polymeric dispersing agents, clay soil removal/anti-redeposition agents, brighteners, suds suppressors, dyes, structure elasticizing agents, fabric softeners, carriers, hydrotropes, processing aids and/or pigments. In addition to the disclosure below, suitable examples of such other adjuncts and levels of use are found in U.S. Pat. No. 6,326,348 B1.

Each adjunct ingredients is not essential to Applicants' compositions. Thus, certain embodiments of Applicants' compositions do not contain one or more of the following adjuncts materials: bleach activators, antimicrobial, surfactants, builders, chelating agents, dye transfer inhibiting agents, dispersants, enzymes, and enzyme stabilizers, catalytic metal complexes, polymeric dispersing agents, clay and soil removal/anti-redeposition agents, brighteners, suds suppressors, dyes, structure elasticizing agents, fabric softeners, carriers, hydrotropes, processing aids and/or pigments. However, when one or more adjuncts are present, such one or more adjuncts may be present as detailed below:

Surfactants—The compositions according to the present invention can comprise a surfactant or surfactant system wherein the surfactant can be selected from nonionic and/or anionic and/or cationic surfactants and/or ampholytic and/or zwitterionic and/or semi-polar nonionic surfactants. The surfactant is typically present at a level of from about 0.1%, from about 1%, or even from about 5% by weight of the cleaning compositions to about 99.9%, to about 80%, to about 35%, or even to about 30% by weight of the cleaning compositions.

Builders—The compositions of the present invention can comprise one or more detergent builders or builder systems. When present, the compositions will typically comprise at least about 1% builder, or from about 5% or 10% to about 80%, 50%, or even 30% by weight, of said builder. Builders include, but are not limited to, the alkali metal, ammonium and alkanolammonium salts of polyphosphates, alkali metal silicates, alkaline earth and alkali metal carbonates, aluminosilicate builders polycarboxylate compounds. ether hydroxypolycarboxylates, copolymers of maleic anhydride with ethylene or vinyl methyl ether, 1,3,5-trihydroxybenzene-2,4,6-trisulphonic acid, and carboxymethyl-oxysuccinic acid, the various alkali metal, ammonium and substituted ammonium salts of polyacetic acids such as ethylenediamine tetraacetic acid and nitrilotriacetic acid, as well as polycarboxylates such as mellitic acid, succinic acid, oxydisuccinic acid, polymaleic acid, benzene 1,3,5-tricarboxylic acid, carboxymethyloxysuccinic acid, and soluble salts thereof.

Chelating Agents—The compositions herein may also optionally contain one or more copper, iron and/or manganese chelating agents. If utilized, chelating agents will generally comprise from about 0.1% by weight of the compositions herein to about 15%, or even from about 3.0% to about 15% by weight of the compositions herein.

Dye Transfer Inhibiting Agents—The compositions of the present invention may also include one or more dye transfer inhibiting agents. Suitable polymeric dye transfer inhibiting agents include, but are not limited to, polyvinylpyrrolidone polymers, polyamine N-oxide polymers, copolymers of N-vinylpyrrolidone and N-vinylimidazole, polyvinyloxazolidones and polyvinylimidazoles or mixtures thereof. When present in the compositions herein, the dye transfer inhibiting agents are present at levels from about 0.0001%, from about 0.01%, from about 0.05% by weight of the cleaning compositions to about 10%, about 2%, or even about 1% by weight of the cleaning compositions.

Dispersants—The compositions of the present invention can also contain dispersants. Suitable water-soluble organic materials are the homo- or co-polymeric acids or their salts, in which the polycarboxylic acid may comprise at least two carboxyl radicals separated from each other by not more than two carbon atoms.

Enzymes—The compositions can comprise one or more detergent enzymes which provide cleaning performance and/or fabric care benefits. Examples of suitable enzymes include, but are not limited to, hemicellulases, peroxidases, proteases, cellulases, xylanases, lipases, phospholipases, esterases, cutinases, pectinases, keratanases, reductases, oxidases, phenoloxidases, lipoxygenases, ligninases, pullulanases, tannases, pentosanases, malanases, β-glucanases, arabinosidases, hyaluronidase, chondroitinase, laccase, and amylases, or mixtures thereof. A typical combination is a cocktail of conventional applicable enzymes like protease, lipase, cutinase and/or cellulase in conjunction with amylase.

Enzyme Stabilizers—Enzymes for use in compositions, for example, detergents can be stabilized by various techniques. The enzymes employed herein can be stabilized by the presence of water-soluble sources of calcium and/or magnesium ions in the finished compositions that provide such ions to the enzymes.

Catalytic Metal Complexes—Applicants' compositions may include catalytic metal complexes. One type of metal-containing bleach catalyst is a catalyst system comprising a transition metal cation of defined bleach catalytic activity, such as copper, iron, titanium, ruthenium, tungsten, molybdenum, or manganese cations, an auxiliary metal cation having little or no bleach catalytic activity, such as zinc or aluminum cations, and a sequestrate having defined stability constants for the catalytic and auxiliary metal cations, particularly ethylenediaminetetraacetic acid, ethylenediaminetetra (methyl-enephosphonic acid) and water-soluble salts thereof. Such catalysts are disclosed in U.S. Pat. No. 4,430,243.

If desired, the compositions herein can be catalyzed by means of a manganese compound. Such compounds and levels of use are well known in the art and include, for example, the manganese-based catalysts disclosed in U.S. Pat. No. 5,576,282.

Cobalt bleach catalysts useful herein are known. Such cobalt catalysts are readily prepared by known procedures, such as taught for example in U.S. Pat. No. 5,597,936.

Compositions herein may also suitably include a transition metal complex of a macropolycyclic rigid ligand—abbreviated as "MRL". As a practical matter, and not by way of limitation, the compositions and cleaning processes herein can be adjusted to provide on the order of at least one part per hundred million of the benefit agent MRL species in the aqueous washing medium, and may provide from about 0.005 ppm to about 25 ppm, from about 0.05 ppm to about 10 ppm, or even from about 0.1 ppm to about 5 ppm, of the MRL in the wash liquor.

Suitable transition-metals in the instant transition-metal bleach catalyst include manganese, iron and chromium. Suitable MRL's herein are a special type of ultra-rigid ligand that is cross-bridged such as 5,12-diethyl-1,5,8,12-tetraazabicyclo[6.6.2]hexa-decane.

Suitable transition metal MRLs are readily prepared by known procedures, such as taught for example in U.S. Pat. No. 6,225,464.

Method of Use

Certain of the consumer products disclosed herein can be used to clean or treat a situs inter alia a surface or fabric. Typically at least a portion of the situs is contacted with an embodiment of Applicants' composition, in neat form or diluted in a liquor, for example, a wash liquor and then the situs may be optionally washed and/or rinsed. In one aspect, a situs is optionally washed and/or rinsed, contacted with a particle according to the present invention or composition comprising said particle and then optionally washed and/or rinsed. For purposes of the present invention, washing includes but is not limited to, scrubbing, and mechanical agitation. The fabric may comprise most any fabric capable of being laundered or treated in normal consumer use conditions. Liquors that may comprise the disclosed compositions may have a pH of from about 3 to about 11.5. Such compositions are typically employed at concentrations of from about 500 ppm to about 15,000 ppm in solution. When the wash solvent is water, the water temperature typically ranges from about 5° C. to about 90° C. and, when the situs comprises a fabric, the water to fabric ratio is typically from about 1:1 to about 30:1.

In addition to the disclosure above, a method of neutralizing harsh odours, in particular harsh odours that impact the trigeminal nerve, for example harsh odours resulting from materials selected from the group consisting of phosphoric acid, salts thereof, and mixtures thereof; formic acid, salts thereof, and mixtures thereof; acetic acid, salts thereof, and mixtures thereof; citric acid, citrate, salts thereof, and mixtures thereof; lactic acid, salts thereof, and mixtures thereof; oxalic acid, salts thereof, and mixtures thereof; sulfuric acid, salts thereof, and mixtures thereof comprising:

a) optionally washing and/or rinsing a situs;
b) contacting said situs with the any composition comprising a perfume selected from the group consisting of a material selected from the group consisting of Table 1 materials and mixtures thereof and/or a perfume selected from the group consisting of a Table 2 perfume and mixtures thereof and/or a perfume delivery system comprising a material selected from the group consisting of Table 1 materials and mixtures thereof and/or a perfume selected from the group consisting of a Table 2 perfume and mixtures thereof; and
c) optionally washing and/or rinsing and/or drying, in one aspect via lined drying and/or machine drying, said situs is disclosed.

TEST METHODS

The degree of acid coverage by a perfume, PRM or product comprising such materials, can be determined via human panel testing For raw material testing 2-4 panelists are used so many PRMs can quickly be screened. The PRM is tested in combination with the acid containing product to determine how well is covers the acid odour. To create a dynamic yet consistent odour product is evaluated in a small cup with a closed lid the product is covered for a fixed time in all cases and the headspace purged and allowed to build for the same time interval before the next panelist can grade. In the consumer situation the product is being tested in effectively an open system. So to give this impression in the cup the headspace is only allowed to build for 2 minutes before removing the lid and evaluating. Gradings are spaced by 20 seconds to avoid the nose becoming saturated and grades are complete in sets of 6 PRMs. Grades between panelists are compared and if more than one grade apart are re-evaluated. Further samples are placed back into test blind to check reproducibility.

For final perfumes they are tested in a larger bathroom to give a more accurate consumer impression of the performance, we also test with a larger base of panelists typically 30 panelists are used.

Evaluations for both PRM and perfume testing are expressed on a 0-5 scale

0=absolutely no acid odour

1=very faint acid odour

2=noticeable character of acid odour but not uncomfortable

3=slight discomfort experienced whilst smelling

4=clear discomfort experienced whilst smelling

5=strong discomfort experienced whilst smelling perfume/PRM having no effect versus unperfumed product

EXAMPLES

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

Example 1

Table 2 Perfume1 is added at 25 and 50% to 3 existing perfumes and incorporated into acid containing surface care products. The resulting product is sprayed in a bathroom with controlled airflow temperature and humidity. In all cases the perfumes with the additional perfume from Example 1 resulted in a significantly lower acid odour as measured by a trained panel of 30 people. The experiment is repeated for each of Table 2 perfumes 2-5 and a similar benefit is obtained.

Example 2

84 wt % Core/16 wt % Wall Melamine Formaldehyde (MF) Capsule (PAD Reservoir System 25 grams of butyl acrylate-acrylic acid copolymer emulsifier (Colloid C351, 25% solids, pka 4.5-4.7, (Kemira Chemicals, Inc. Kennesaw, Ga. U.S.A.) is dissolved and mixed in 200 grams deionized water. The pH of the solution is adjusted to pH of 4.0 with sodium hydroxide solution. 8 grams of partially methylated methylol melamine resin (Cymel 385, 80% solids, (Cytec Industries West Paterson, N.J., U.S.A.)) is added to the emulsifier solution. 200 grams of a material selected from the group consisting of Table 1 materials and mixtures thereof and/or a perfume selected from the group consisting of a Table 2 perfume and mixtures thereof, the balance of consumer product comprising an adjunct ingredient, and/or a perfume delivery system comprising a material selected from the group consisting of Table 1 materials and mixtures thereof and/or a perfume selected from the group consisting of a Table 2 perfume and mixtures thereof is added to the previous mixture under mechanical agitation and the temperature is raised to 50° C. After mixing at higher speed until a stable emulsion is obtained, the second solution and 4 grams of sodium sulfate salt are added to the emulsion. This second solution contains 10 grams of butyl acrylate-acrylic acid copolymer emulsifier (Colloid C351, 25% solids, pka 4.5-4.7, Kemira), 120 grams of distilled water, sodium hydroxide solution to adjust pH to 4.8, 25 grams of partially methylated methylol melamine resin (Cymel 385, 80% solids, Cytec). This mixture is heated to 70° C. and maintained overnight with continuous stirring to complete the encapsulation process. 23 grams of acetoacetamide (Sigma-Aldrich, Saint Louis, Mo., U.S.A.) is added to the suspension. An average capsule size of 30 um is obtained as analyzed by a Model 780 Accusizer.

Example 3

Product Formulation—Fabric Softener

Non-limiting examples of product formulations containing PRMs disclosed in the present specification perfume and amines summarized in the following table.

| | EXAMPLES | | | | | | | | | |
|---|---|---|---|---|---|---|---|---|---|---|
| (% wt) | XI | XII | XIII | XIV | XV | XVI | XVII | XVIII | XIX | XX |
| FSA [a] | 14 | 16.47 | 14 | 12 | 12 | 16.47 | — | — | 5 | 5 |
| FSA [b] | | | | | — | | 3.00 | — | — | — |
| FSA [c] | | | | | — | | — | 6.5 | — | — |
| Ethanol | 2.18 | 2.57 | 2.18 | 1.95 | 1.95 | 2.57 | — | — | 0.81 | 0.81 |
| Isopropyl Alcohol | — | — | — | — | — | — | 0.33 | 1.22 | — | — |
| Starch [d] | 1.25 | 1.47 | 2.00 | 1.25 | — | 2.30 | 0.5 | 0.70 | 0.71 | 0.42 |
| Amine* | 0.6 | 0.75 | 0.6 | 0.75 | 0.37 | 0.60 | 0.37 | 0.6 | 0.37 | 0.37 |
| Perfume X[e] | 0.40 | 0.13 | 0.065 | 0.25 | 0.03 | 0.030 | 0.030 | 0.065 | 0.03 | 0.03 |
| Phase Stabilizing Polymer [f] | 0.21 | 0.25 | 0.21 | 0.21 | 0.14 | — | — | 0.14 | — | — |
| Suds Suppressor [g] | — | — | — | — | — | — | — | 0.1 | — | — |
| Calcium Chloride | 0.15 | 0.176 | 0.15 | 0.15 | 0.30 | 0.176 | — | 0.1-0.15 | — | — |

-continued

| (% wt) | EXAMPLES | | | | | | | | | |
|---|---|---|---|---|---|---|---|---|---|---|
| | XI | XII | XIII | XIV | XV | XVI | XVII | XVIII | XIX | XX |
| DTPA [h] | 0.017 | 0.017 | 0.017 | 0.017 | 0.007 | 0.007 | 0.20 | — | 0.002 | 0.002 |
| Preservative (ppm) [i,j] | 5 | 5 | 5 | 5 | 5 | 5 | — | 250 [j] | 5 | 5 |
| Antifoam[k] | 0.015 | 0.018 | 0.015 | 0.015 | 0.015 | 0.015 | — | — | 0.015 | 0.015 |
| Dye (ppm) | 40 | 40 | 40 | 40 | 40 | 40 | 11 | 30-300 | 30 | 30 |
| Ammonium Chloride | 0.100 | 0.118 | 0.100 | 0.100 | 0.115 | 0.115 | — | — | — | — |
| HCl | 0.012 | 0.014 | 0.012 | 0.012 | 0.028 | 0.028 | 0.016 | 0.025 | 0.011 | 0.011 |
| Structurant[l] | 0.01 | 0.01 | 0.01 | 0.01 | 0.01 | 0.01 | 0.01 | 0.01 | 0.01 | 0.01 |
| Additional Adjunct Perfume | 0.8 | 0.7 | 0.9 | 0.5 | 1.2 | 0.5 | 1.1 | 0 | 1.0 | 0.9 |
| Deionized Water | † | † | † | † | † | † | † | † | † | † |

[a] N,N-di(tallowoyloxyethyl)-N,N-dimethylammonium chloride.

[b] Methyl bis(tallow amidoethyl)2-hydroxyethyl ammonium methyl sulfate.

[c] Reaction product of Fatty acid with Methyldiethanolamine in a molar ratio 1.5:1, quaternized with Methylchloride, resulting in a 1:1 molar mixture of N,N-bis(stearoyl-oxy-ethyl) N,N-dimethyl ammonium chloride and N-(stearoyl-oxy-ethyl) N,-hydroxyethyl N,N dimethyl ammonium chloride.

[d] Cationic high amylose maize starch available from National Starch under the trade name CATO ®.

[e] A perfume selected from Table 12 perfumes 1-5.

[f] Copolymer of ethylene oxide and terephthalate having the formula described in U.S. Pat. No. 5,574,179 at col.15, lines 1-5, wherein each X is methyl, each n is 40, u is 4, each R1 is essentially 1,4-phenylene moieties, each R2 is essentially ethylene, 1,2-propylene moieties, or mixtures thereof.

[g] SE39 from Wacker

[h] Diethylenetriaminepentaacetic acid.

[i] KATHON ® CG available from Rohm and Haas Co. "PPM" is "parts per million."

[j] Gluteraldehyde

[k] Silicone antifoam agent available from Dow Corning Corp. under the trade name DC2310.

[l] Hydrophobically-modified ethoxylated urethane available from Rohm and Haas under the tradename Aculan 44.

* One or more materials comprising an amine moiety as disclosed in the present specification.

† balance

Example 4

Dry Laundry Formulations

| Component | % w/w granular laundry detergent composition | | | | | | |
|---|---|---|---|---|---|---|---|
| | A | B | C | D | E | F | G |
| Brightener | 0.1 | 0.1 | 0.1 | 0.2 | 0.1 | 0.2 | 0.1 |
| Soap | 0.6 | 0.6 | 0.6 | 0.6 | 0.6 | 0.6 | 0.6 |
| Ethylenediamine disuccinic acid | 0.1 | 0.1 | 0.1 | 0.1 | 0.1 | 0.1 | 0.1 |
| Acrylate/maleate copolymer | 1.5 | 1.5 | 1.5 | 1.5 | 1.5 | 1.5 | 1.5 |
| Hydroxyethane di(methylene phosphonic acid) | 0.4 | 0.4 | 0.4 | 0.4 | 0.4 | 0.4 | 0.4 |
| Mono-$C_{12-14}$ alkyl, di-methyl, mono-hydroyethyl quaternary ammonium chloride | 0.5 | 0.5 | 0.5 | 0.5 | 0.5 | 0.5 | 0.5 |
| Linear alkyl benzene | 0.1 | 0.1 | 0.2 | 0.1 | 0.1 | 0.2 | 0.1 |
| Linear alkyl benzene sulphonate | 10.3 | 10.1 | 19.9 | 14.7 | 10.3 | 17 | 10.5 |
| Magnesium sulphate | 0.4 | 0.4 | 0.4 | 0.4 | 0.4 | 0.4 | 0.4 |
| Sodium carbonate | 19.5 | 19.2 | 10.1 | 18.5 | 29.9 | 10.1 | 16.8 |
| Sodium sulphate | 29.6 | 29.8 | 38.8 | 15.1 | 24.4 | 19.7 | 19.1 |
| Sodium Chloride | 0.1 | 0.1 | 0.1 | 0.1 | 0.1 | 0.1 | 0.1 |
| Zeolite | 9.6 | 9.4 | 8.1 | 18 | 10 | 13.2 | 17.3 |
| Photobleach particle | 0.1 | 0.1 | 0.2 | 0.1 | 0.2 | 0.1 | 0.2 |
| Blue and red carbonate speckles | 1.8 | 1.8 | 1.8 | 1.8 | 1.8 | 1.8 | 1.8 |
| Ethoxylated Alcohol AE7 | 1 | 1 | 1 | 1 | 1 | 1 | 1 |
| Tetraacetyl ethylene diamine agglomerate (92 wt % active) | 0.9 | 0.9 | 0.9 | 0.9 | 0.9 | 0.9 | 0.9 |
| Citric acid | 1.4 | 1.4 | 1.4 | 1.4 | 1.4 | 1.4 | 1.4 |
| PDMS/clay agglomerates (9.5% wt % active PDMS) | 10.5 | 10.3 | 5 | 15 | 5.1 | 7.3 | 10.2 |
| Polyethylene oxide | 0.2 | 0.2 | 0.2 | 0.2 | 0.2 | 0.2 | 0.2 |
| Enzymes e.g. Protease (84 mg/g active), Amylase (22 mg/g active) | 0.2 | 0.3 | 0.2 | 0.1 | 0.2 | 0.1 | 0.2 |
| Suds suppressor agglomerate (12.4 wt % active) | 0.2 | 0.2 | 0.2 | 0.2 | 0.2 | 0.2 | 0.2 |

-continued

| Component | % w/w granular laundry detergent composition | | | | | | |
|---|---|---|---|---|---|---|---|
| | A | B | C | D | E | F | G |
| Sodium percarbonate (having from 12% to 15% active AvOx) | 7.2 | 7.1 | 4.9 | 5.4 | 6.9 | 19.3 | 13.1 |
| Additional Adjunct Perfume** | 0.5 | 0.5 | 0.5 | 0.5 | 0.5 | 0.5 | 0.5 |
| Amine* | 0.1 | 0.5 | 0.0 | 0.01 | 0.02 | 0.00 | 0.07 |
| Perfume Delivery System As Disclosed In The Present Specification | 0.05 | 0.0 | 0.1 | 0.0 | 0.2 | 0.4 | 0.0 |
| A Perfume Selected Table 2 Perfumes 1-5 | 0.3 | 0.4 | 0.01 | 0.02 | 0.04 | 0.1 | 0.1 |
| Water | 1.4 | 1.4 | 1.4 | 1.4 | 1.4 | 1.4 | 1.4 |
| Misc | 0.1 | 0.1 | 0.1 | 0.1 | 0.1 | 0.1 | 0.1 |
| Total Parts | 100 | 100 | 100 | 100 | 100 | 100 | 100 |

*One or more materials comprising an amine moiety as disclosed in the present specification.
**Optional

Example 5

Liquid Laundry Formulations (HDLs)

| Ingredient | HDL 1 | HDL 2 | HDL3 | HDL4 | HDL 5 | HDL 6 |
|---|---|---|---|---|---|---|
| Alkyl Ether Sulphate | 0.00 | 0.50 | 12.0 | 12.0 | 6.0 | 7.0 |
| Dodecyl Benzene Sulphonic Acid | 8.0 | 8.0 | 1.0 | 1.0 | 2.0 | 3.0 |
| Ethoxylated Alcohol | 8.0 | 6.0 | 5.0 | 7.0 | 5.0 | 3.0 |
| Citric Acid | 5.0 | 3.0 | 3.0 | 5.0 | 2.0 | 3.0 |
| Fatty Acid | 3.0 | 5.0 | 5.0 | 3.0 | 6.0 | 5.0 |
| Ethoxysulfated hexamethylene diamine quaternized | 1.9 | 1.2 | 1.5 | 2.0 | 1.0 | 1.0 |
| Diethylene triamine penta methylene phosphonic acid | 0.3 | 0.2 | 0.2 | 0.3 | 0.1 | 0.2 |
| Enzymes | 1.20 | 0.80 | 0 | 1.2 | 0 | 0.8 |
| Brightener (disulphonated diamino stilbene based FWA) | 0.14 | 0.09 | 0 | 0.14 | 0.01 | 0.09 |
| Cationic hydroxyethyl cellulose | 0 | 0 | 0.10 | 0 | 0.200 | 0.30 |
| Poly(acrylamide-co-diallyldimethylammonium chloride) | 0 | 0 | 0 | 0.50 | 0.10 | 0 |
| Hydrogenated Castor Oil Structurant | 0.50 | 0.44 | 0.2 | 0.2 | 0.3 | 0.3 |
| Boric acid | 2.4 | 1.5 | 1.0 | 2.4 | 1.0 | 1.5 |
| Ethanol | 0.50 | 1.0 | 2.0 | 2.0 | 1.0 | 1.0 |
| 1, 2 propanediol | 2.0 | 3.0 | 1.0 | 1.0 | 0.01 | 0.01 |
| Glutaraldehyde | 0 | 0 | 19 ppm | 0 | 13 ppm | 0 |
| Diethyleneglycol (DEG) | 1.6 | 0 | 0 | 0 | 0 | 0 |
| 2,3-Methyl-1,3-propanediol (M pdiol) | 1.0 | 1.0 | 0 | 0 | 0 | 0 |
| Mono Ethanol Amine | 1.0 | 0.5 | 0 | 0 | 0 | 0 |
| NaOH Sufficient To Provide Formulation pH of: | pH 8 | pH 8 | pH 8 | pH 8 | pH 8 | pH 8 |
| Sodium Cumene Sulphonate (NaCS) | 2.00 | 0 | 0 | 0 | 0 | 0 |
| Silicone (PDMS) emulsion | 0.003 | 0.003 | 0.003 | 0.003 | 0.003 | 0.003 |
| Additional Adjunct Perfume** | 0.7 | 0.5 | 0.8 | 0.6 | 0.6 | 0.5 |
| Amine* | 0.01 | 0.10 | 0.0 | 0.10 | 0.20 | 0.05 |
| A perfume from Table 2 perfumes 1-5 | 0.02 | 0.15 | 0.10 | 0.2 | 0.3 | 0.05 |
| Perfume Delivery System As Disclosed In The Present Specification | 0.2 | 0.02 | 0.4 | 0.0 | 0.0 | 0.0 |
| Water | Balance | Balance | Balance | Balance | Balance | Balance |

*One or more materials comprising an amine moiety as disclosed in the present specification.
**Optional.

Example 6

These following compositions are made comprising the listed ingredients in the listed proportions (weight %).

| Ingredients: (% by weight) | I | II | III | IV | V | VI | VII |
|---|---|---|---|---|---|---|---|
| Phosphoric acid | 12 | 12 | 10 | 15 | 12 | 12 | 15 |
| Formic acid | 1.8 | 0.8 | 3 | 0.2 | 2 | 2 | — |
| HEDP | 0.1 | — | — | — | 0.1 | — | — |
| Dobanol 91-8 | 2.2 | 2.2 | 2.2 | 2.2 | — | — | 2.2 |
| Luviskol K60 ® | 0.05 | 0.05 | 0.05 | — | — | — | 0.05 |
| Kelzan T ® | 0.28 | 0.28 | 0.28 | — | — | — | 0.28 |
| Perfume(*) | 0.25 | 0.25 | 0.25 | 0.25 | 0.25 | 0.25 | — |
| Waters & Minors | | | Up to 100 | | | | |

The pH of these examples is below 7.

Phosphoric acid is purchased from J. T. Baker.

Formic acid is supplied by Fluka.

HEDP is a chelating agent supplied by Monsanto.

Dobanol 91-8 is an ethoxylated alcohol nonionic surfactant supplied by Shell.

Kelzan T® is a Xanthan gum supplied by Kelco.

Luviskol K60® is a Polyvinylpyrrolidone supplied by BASF.

Perfume(*) From Table 2 perfumes 1-5.

Compositions I to VI exhibit limescale removal performance under soaking conditions, and provide cleaning performance on greasy soap scum as they comprise a nonionic surfactant yet do not exhibit the typical harsh odour.

Example 7

These following compositions are made comprising the listed ingredients in the listed proportions (weight %).

| Formulations: | I | II | III | IV | V | VI | VII | VIII | IX |
|---|---|---|---|---|---|---|---|---|---|
| Acids | | | | | | | | | |
| Formic acid | 2.0 | 2.7 | 2.5 | 1.8 | 1.5 | 2.0 | 2.8 | 1.8 | 4.0 |
| Acetic acid | — | — | 0.75 | — | 0.5 | — | — | — | — |
| Citric acid | 3.5 | 4.6 | 4.0 | 8.0 | 1.5 | 3.0 | 2.0 | — | — |
| Lactic acid | — | — | — | 1.0 | — | 2.0 | 1.0 | — | 1.5 |
| Sulfuric acid | — | — | — | — | — | — | — | 3.0 | 3.0 |
| Surfactants | | | | | | | | | |
| Neodol 91-8 ® | 0.5 | 2.2 | 2.2 | 2.2 | 2.5 | 0.45 | 2.5 | — | — |
| Sulphated Safol 23 ® | 2.0 | — | — | — | — | — | — | — | — |
| H-LAS | — | — | — | — | — | 0.80 | — | 0.90 | 1.30 |
| NaCS | — | — | — | — | — | 1.80 | — | 2.20 | 2.50 |
| Polymers: | | | | | | | | | |
| Kelzan T ® | 0.40 | 0.25 | 0.25 | 0.25 | 0.30 | 0.10 | 0.40 | 0.45 | 0.60 |
| PVP | 0.25 | 0.05 | — | 0.25 | 0.05 | — | 0.25 | — | — |
| SF 1288 ® | — | — | — | — | — | 0.60 | | 0.90 | 1.80 |
| Solvent: | | | | | | | | | |
| n-BPP | 1.0 | — | — | 1.5 | — | — | — | — | — |
| Misc.: | | | | | | | | | |
| BHT | 0.03 | 0.03 | 0.03 | 0.03 | 0.05 | — | 0.03 | 0.15 | 0.15 |
| Perfume** | 0.05 | 0.50 | 0.20 | 0.50 | 0.30 | 0.50 | 0.25 | 0.40 | 0.35 |
| Dye | 0.01 | 0.005 | 0.005 | 0.01 | 0.01 | 0.01 | 0.01 | 0.01 | 0.005 |
| Alkaline Material: | | | | | | | | | |
| KOH-to pH: | 2.3 | — | — | — | 2.8 | — | — | — | — |
| NaOH-to pH: | — | 2.2 | 2.3 | 3.6 | — | 2.5 | 2.3 | — | — |
| pH (w/o alkaline material added) | — | — | — | — | — | — | — | 0.5 | 0.5 |
| Water: | | | | | up to 100% | | | | |

| Examples: | X | XI | XII | XIII | XIV |
|---|---|---|---|---|---|
| Acids | | | | | |
| Formic acid | 2.5 | 2.8 | 2.7 | 1.0 | 2.0 |
| Citric acid | 3.6 | 1.0 | 2.0 | 3.0 | 1.0 |
| Oxalic acid | 1.0 | — | — | — | — |
| Surfactants | | | | | |
| Neodol 91-8 ® | 2.5 | 0.5 | 2.2 | 1.5 | 2.0 |
| Sulphated Safol 23 ® | — | — | — | — | 0.8 |
| Sodium Lauryl Sulphate | — | 3.0 | 2.0 | 1.5 | — |
| Kelzan T ® | 0.28 | 0.10 | 0.35 | 0.25 | 0.40 |
| PVP | 0.05 | — | 0.25 | 0.05 | 0.25 |
| n-BPP | — | 3.5 | 2.5 | 1.6 | 2.5 |
| BHT | 0.04 | — | — | — | — |
| Perfume** | 0.25 | 0.60 | 0.40 | 0.20 | 0.35 |
| Dye | 0.005 | 0.005 | 0.01 | 0.005 | 0.01 |
| KOH ® to pH : | — | 3.6 | — | — | — |

-continued

| | | | | |
|---|---|---|---|---|
| NaOH ® to pH : 2.3 | — | 3.0 | 3.3 | 3.6 |
| pH (w/o alkaline material added) | — | — | — | |
| Water: | | up to 100% | | |

Formic acid, citric acid, lactic acid, acetic acid, oxalic acid and sulphuric acid are commercially available from Aldrich.
Neodol 91-8 ® is a $C_9$-$C_{11}$ EO8 nonionic surfactant, commercially available from SHELL.
Sulphated Safol 23 ® is a branched $C_{12-13}$ sulphate surfactant based on Safol 23 ®, an alcohol commercially available from Sasol, which has been sulphated.
Sodium lauryl sulfate is a linear C12-14 sulfate which is commercially available from Aldrich.
n-BPP is n-butoxy propoxy propanol.
Kelzan T ® is a Xanthan gum supplied by Kelco.
PVP is a vinylpyrrolidone homopolymer, commercially available from ISP Corporation.
SF 1288 ® is a silicone-polyether copolymer, commercially available from Momentive Performance Materials.
BHT is Butylated Hydroxy Toluene
Perfume** from Table 2 perfumes 1-5 or comprising a perfume raw material from Table 1

Compositions I to XIV exhibit limescale removal performance under soaking conditions, and provide cleaning performance on greasy soap scum as they comprise a nonionic surfactant yet do not exhibit the typical harsh odour.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

All documents cited in the Detailed Description of the Invention are, in relevant part, incorporated herein by reference; the citation of any document is not to be construed as an admission that it is prior art with respect to the present invention. To the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A consumer product comprising a sufficient amount of formic acid to result in said composition having a pH from about 0.01 to about 6.99, said consumer product comprising:

a) from about 0.01% to about 0.6%, based on total perfume composition weight, Habanolide; and b) a surfactant.

2. A consumer product according to claim 1, said consumer product comprising a sufficient amount of formic acid to result in said composition having a pH from about 0.2 to about 5.

3. A consumer product according to claim 1, said consumer product comprising a sufficient amount of formic acid to result in said composition having a pH from about 0.3 to about 4.

4. A consumer product according to claim 1, said consumer product comprising a sufficient amount of formic acid to result in said composition having a pH from about 0.8 to about 4.

5. A consumer product according to claim 1, said consumer product comprising a sufficient amount of formic acid to result in said composition having a pH from about 0.01 to about 6.99 said consumer product comprising:

a) from about 0.25% to about 0.6%, based on total perfume composition weight, Habanolide.

6. The consumer product of claim 1, said consumer product comprising an additional strong acid.

7. The consumer product according to claim 1, said consumer product comprising a material selected from the group consisting of phosphoric acid, salts of phosphoric acid, salts of formic acid, acetic acid, salts of acetic acid, citric acid, salts of citric acid, lactic acid, salts of lactic acid, oxalic acid, salts of oxalic acid, sulfuric acid, salts of sulfuric acid and mixtures thereof.

8. The consumer product of claim 7, said consumer product comprising a material selected from the group consisting of phosphoric acid, salts of phosphoric acid, salts of formic acid, acetic acid, salts of acetic acid, citric acid, salts of citric acid, lactic acid, salts of lactic acid, oxalic acid, salts of oxalic acid and mixtures thereof.

9. The consumer product of claim 1, said consumer product is a liquid detergent comprising materials selected from the group consisting of bleach activators, antimicrobial, builders, chelating agents, dye transfer inhibiting agents, dispersants, enzymes, and enzyme stabilizers, catalytic materials, bleach activators, polymeric dispersing agents, clay soil removal/anti-redeposition agents, brighteners, suds suppressors, dyes, structure elasticizing agents, fabric softeners, carriers, hydrotropes, processing aids and/or pigments.

10. The consumer product of claim 1, said consumer product being a hard surface cleaner comprising a material selected from the group consisting of an anti-bacterial, a strong acid, a strong base, an effervescent, a propellant, a shine/sheeting polymers and mixtures thereof.

11. A consumer product according to claim 1 comprising:

a perfume composition comprising, a perfume material selected from the group consisting of Menthol; Orange CP; Methyl Beta-Naphthyl Ketone; Cashmeran; 2 6 Nonadienol 10% In DPG; terpineol; Isobornyl acetate; Scentenal; Iso-E Super; Prenyl Acetate; beta-pinene; lemon CP; Amyl acetate; Acalea; Ionone Gamma Methyl; Octalynol; 4-tert-Butylcyclohexyl acetate; Javanol; bornyl propionate; Indolene; Linalool; Indol; Prenyl Acetate; Spirogalbanone; (R)-gamma-Undecalactone; Nonalactone; peonile; Magnolan; Orange Terpenes; Hexadecanolide; Bisabolene; Frutene; Muscenone; cis-3-Hexen-1-oland mixtures thereof.

12. The consumer product of claim 1, said consumer product being an automatic dishwashing composition, said automatic dish washing composition being:

a) a liquid or gel comprising a material selected from an anti-redeposition polymer, an enzyme, a structurant, a shine/sheeting polymer and mixtures thereof; or b) a unit dose comprising a material selected from the group consisting of an anti-redeposition polymer, an enzyme, a bleach, a shine/sheeting polymer, a soluble substrate/film and mixtures thereof.

13. The consumer product of claim 1, wherein said perfume composition is contained in a perfume delivery system.

14. A method comprising:

a) optionally washing and/or rinsing a situs;

b) contacting said situs with a consumer product according to claim 1;

c) optionally washing and/or rinsing and/or drying, in one aspect via lined drying and/or machine drying, said situs.

* * * * *